United States Patent [19]

Granger

[11] Patent Number: 4,552,315

[45] Date of Patent: Nov. 12, 1985

[54] ROLLED WEB DISPENSER

[76] Inventor: Maurice Granger, 17 rue Marcel Pagnol, 42270 Saint-Priest-en-Jarez, France

[21] Appl. No.: 533,661

[22] Filed: Sep. 19, 1983

[30] Foreign Application Priority Data

Jan. 13, 1983 [FR] France ..... 83 00737
Jun. 21, 1983 [FR] France ..... 83 10533

[51] Int. Cl.[4] ..... B65H 19/04
[52] U.S. Cl. ..... 242/55.3; 312/39
[58] Field of Search ..... 242/55.3, 55.53, 55.42; 225/47, 53, 46; 312/38–40

[56] References Cited

U.S. PATENT DOCUMENTS

| | | | |
|---|---|---|---|
| 3,382,021 | 5/1968 | DeWoskin | 312/39 |
| 3,416,744 | 12/1968 | Mott, Sr. et al. | 242/55.3 |
| 3,771,739 | 11/1973 | Nelson | 242/55.3 |
| 3,865,295 | 2/1975 | Okamura | 225/47 |
| 3,948,454 | 4/1976 | Bastian | 242/55.3 |
| 4,137,805 | 2/1979 | DeLuca et al. | 83/345 |

*Primary Examiner*—Leonard D. Christian
*Attorney, Agent, or Firm*—Eric P. Schellin

[57] ABSTRACT

A dispensing apparatus for rolls of web material with a device for automatically substituting the roll being used. The roll being used is carried by one support, and a spare roll is carried by a second support, the two supports being mounted pivotally on a rigid structure.

16 Claims, 12 Drawing Figures

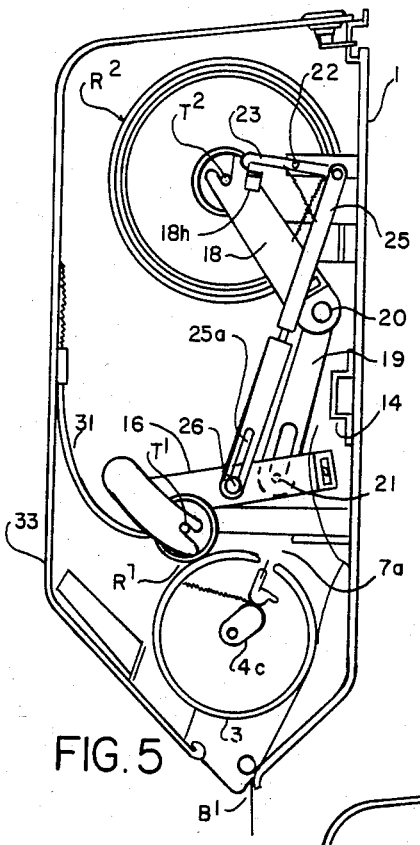
FIG. 5
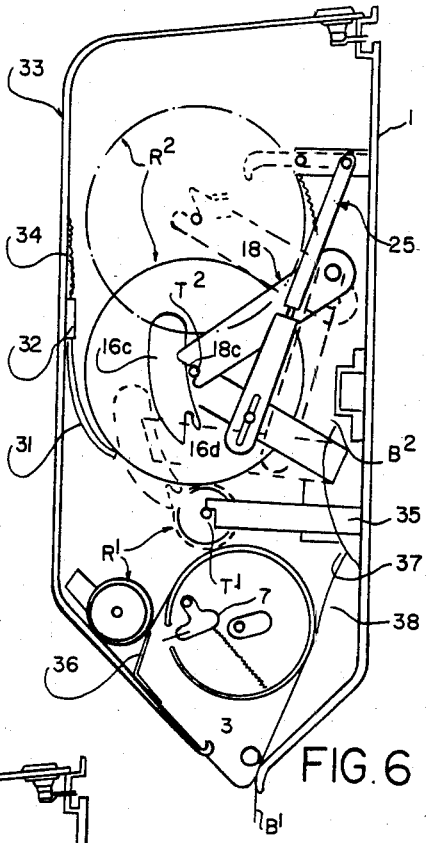
FIG. 6
FIG. 7
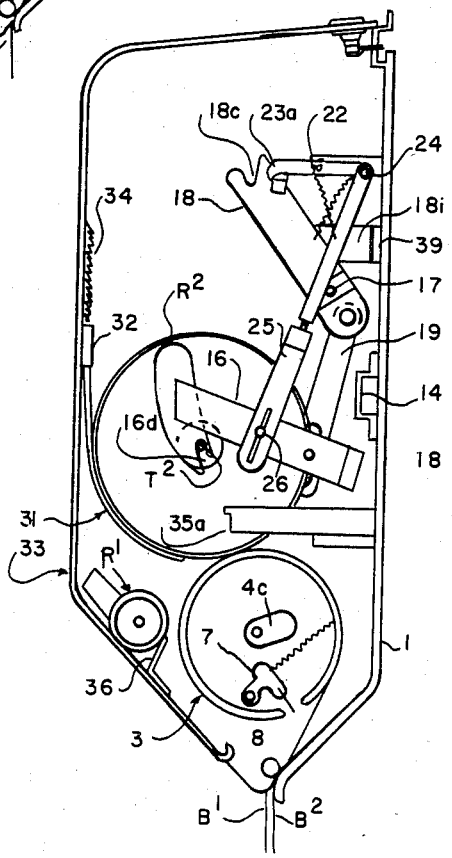

FIG. 8
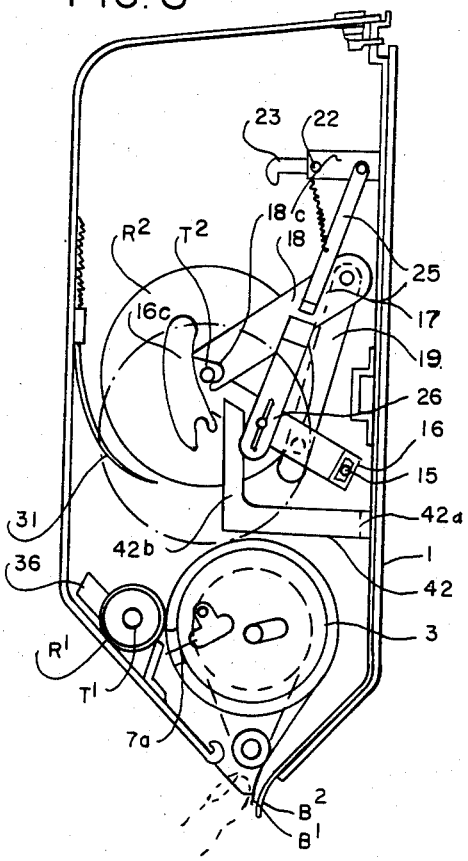
FIG. 9
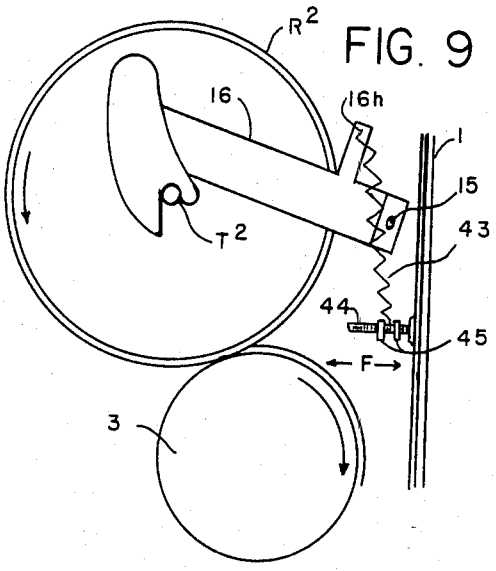
FIG. 10
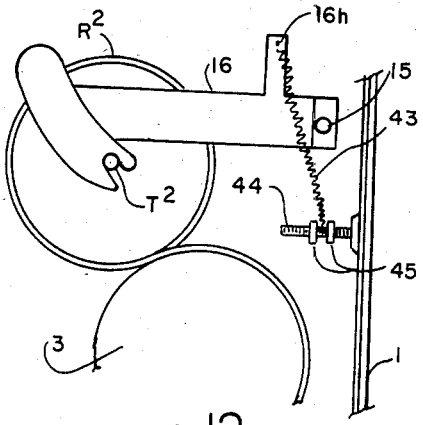
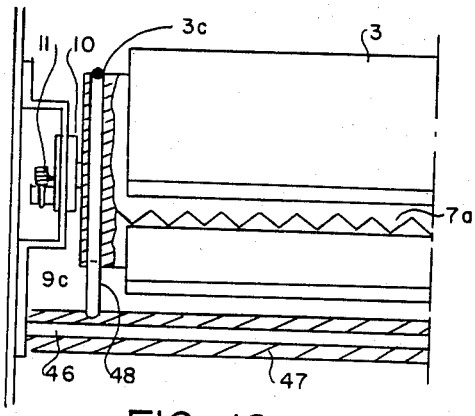
FIG. 12
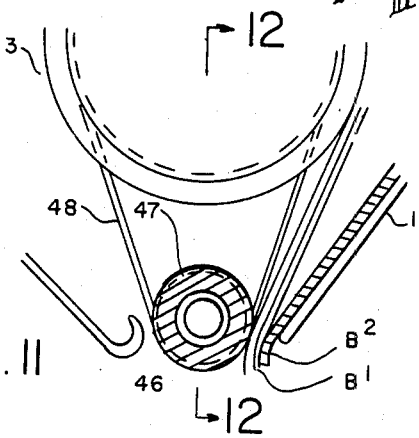
FIG. 11

ROLLED WEB DISPENSER

BACKGROUND OF THE INVENTION

The present invention is directed to an apparatus for dispensing webs of rolled-up material wherein means is provided for automatically replacing the roll being used.

The present invention pertains to the art of dispensing webs of material which are wound around a reel or a core. More particularly, but not restrictively, the invention relates to apparatus for simultaneously dispensing and severing paper, cotton wool, and other wiping materials.

SUMMARY OF THE INVENTION

In accordance with the invention, there is provided an apparatus making it possible to dispense a web rolled up on a reel. Prior to the reel being entirely paid off, the machine automatically and continuously dispenses a fresh web wound up on a second reel, available as a spare reel.

The apparatus of the present invention is comprised of a roll being used which is carried by a support, and a spare roll carried by a second support. The two supports are mounted pivotally on a rigid structure. The two supports are connected to one another by means of a small rod linked hingedly with play on one side in order to move the rigid arms supporting the rolls of material to be dispensed toward one another, and to transfer automatically the spare roll onto the support of the roll which has been in use, at which time the roll which has been in use is ejected. A mechanism hinged to the support of the roll in use makes the support of the spare roll free from the interlocking means of this support when the roll in use is practically totally paid off, the webs of material from both rolls being then dispersed simultaneously until the roll in use is exhausted. The support of the spare roll returns automatically to the waiting position thereof by elastic return and automatic tripping of the interlocking means.

DETAILED DESCRIPTION OF THE DRAWINGS

In order to make the object of the invention more concrete, without, however, restricting it, the invention is described more fully by the attached drawings.

FIG. 1 is a front view illustrating an apparatus for the simultaneous dispensing and severing of rolled up webs of materials, in accordance with the present invention. The apparatus, without casing, is shown in the loaded and inactive condition, with its device for the automatic changing of the roll being used.

FIGS. 2 and 3 are sectional views along the lines 2—2 and 3—3 of FIG. 1, showing the main elements of the apparatus.

FIGS. 5, 6 and 7 are schematic views on a smaller scale which illustrate various steps of the operation of the device for the automatic changing of the roll being used.

FIG. 8 is a sectional view illustrating an alternative form of embodiment for the transfer of the spare roll to the support of the roll being used.

FIGS. 9 and 10 are a schematic view of a third alternative form of embodiment.

FIG. 11 is a partial view, on a larger scale, of one of the alternative embodiments of the present invention.

FIG. 12 is a partial front view, showing a partial section along the line 12—12 of FIG. 11.

Figure 1:
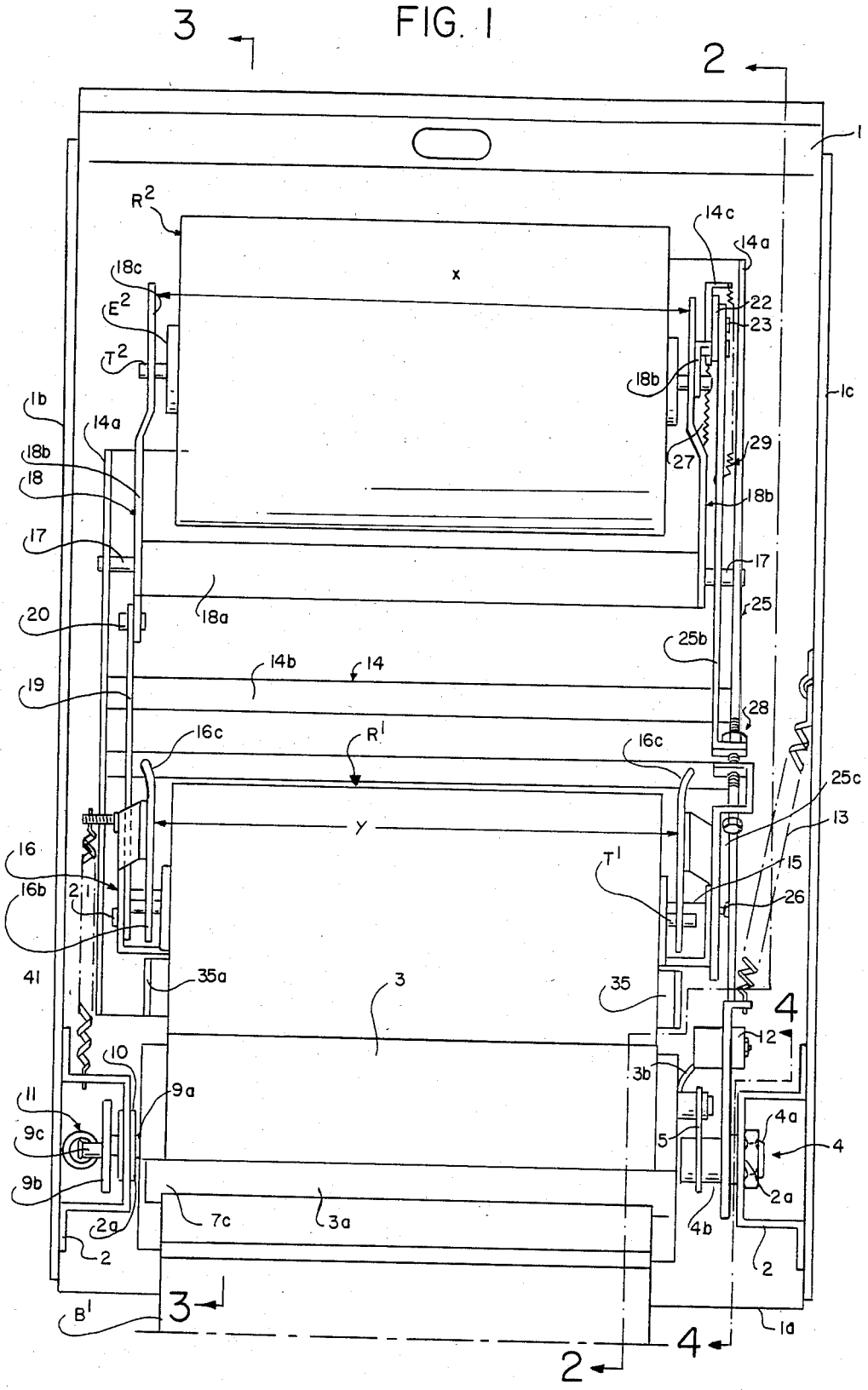

In the example illustrated in the drawings, the apparatus includes a base plate (1) for wall fastening, with a slanting bottom (1*a* ) and two lateral sides (1*b*–1*c*), the lower portion of which has directly or in an inserted manner a bearing (2) provided with a slot (2*a*) for mounting the support means for free rotation of a drum (3), the periphery of which is roughened in order to drive the free end of the material to be dispensed without slipping, rolled up around a reel in abutment of the drum. In a known manner, the support means for the drum consists on one side of a fixed shaft (4) including, in succession, a screw threaded bearing part (4*a*) with parallel flat portions for engagement without rotating within the slot (2*a*) of a bearing (2), and then a smooth bearing part (4*b*) of larger diameter on which is applied a cleat (5) linked hingedly at (6) to a side wall of the drum. Inside the drum, the shaft (4) has a bearing part for the free rotation of the drum. On the end of the shaft is an eccentric (4*c*) which is suitably oriented and dimensioned for the control of the swivelling of a blade holder (7) linked hingedly at (8) to the side walls of the drum, to obtain periodically the projection of the blade (7*a*) outside the drum which is provided with an opening (3*a*) for this purpose. These well-known arrangements are clearly apparent from FIGS. 5, 6 and 7.

On the other side, the support means for rotation of the drum consists of a shaft (9), an end of which is made fast with the lateral wall of the drum, while the central portion (9*a*) of the shaft is rotated within a ring (10) with parallel flat portions or other angular indexing means, engaged within the slot (2*a*) of the bearing (2). Finally, the shaft (9) is provided with a collar (9*b*) supporting an eccentric ring (9*c*) which is oriented angularly and connected to a spring (11) attached to a lateral side (1*b*) of the wall plate in order to effect starting of the drum after the blade severs the material, in order to return the drum to the initial position thereof with a protruding fresh web of material.

During rotation of the drum, an oriented projection (3*b*) of the lateral wall is moved away (by mounting play of the drum) from a shock absorber (12) linked hingedly to the screw-threaded bearing part (2*a*) of the shaft (2). When the projection has been moved past the shock absorber, the drum is stopped by abutment of the cleat (5) on the shaft, while the drum, due to the reaction, moves back again until the projection (3*b*) is abutted on the shock absorber which takes up the strain and gives it back by means of its retaining spring (13) attached to a lateral side (1*c*) wall of the wall plate. At this moment, the cleat (5) is rocked by gravity due to the eccentric linkage thereof, releasing the drum which is thus ready to be driven again by a pull exerted on the protruding web of the material.

The device for the automatic change of the roll being used comprises a rigid structure (14) fastened onto the wall plate (1) and consisting, for instance, of two lateral posts (14*a*) and of a crosspiece (14*b*).

In the lower part, situated above the drum, the structure carries a support (16) for free rotation at (15). The support (16) is formed rigidly of a linking crosspiece (16*a*) and two parallel arms (16*b*). At the free ends of the arms (16*b*) are secured small plates (16*c*) which are crescent-shaped, with the lower ends thereof forming the cradles (16*d*) for accomodating and positioning the roll of material (R1) for free rotation, through journals (T1) which are formed on ferrules (E1) centered within the reel or the winding core of the material.

In the same manner, in the upper part, the structure (14) carries, at (17), a support (18) formed rigidly of a linking crosspiece (18*a*) and of two parallel arms (18*b*). The free ends of the arms form the cradles (18*c*) for accomodating and positioning the journals (T2) formed on ferrules (E2) which are centered within the reel or core of a roll (R2) of material to be dispensed. The support (18) is returned to the upper position by a spring (27).

Hereinafter in the description, the rolls (R1 and R2) and respectively called "the roll in use" and "spare roll". When roll (R1) is almost entirely paid off, it is to be substituted automatically for the roll (R2) which is mounted in the upper part.

The two supports (16 and 18) are connected to one another by a small rod (19) which is linked hingedly at (20) to a protruding lug (18*d*) of the support (18) and linked hingedly, in an adjustable manner, to a stud (21) secured to an arm (16*b*) of the support (16) through the intermediary of an oblong opening (19*a*) of the small rod.

The arms of the two supports (16 and 18) are dimensioned and spaced apart from one another in a precise manner so that the free ends which form the cradles (16*d*)–(18*c*) will cross one another by the action of the connecting small rod (19). For this purpose, the distance (x) between the cradles (18*c*) is greater than the distance (y) between the cradles (16*d*).

It will also be noted that the cradles (18*c*) are oriented and shaped to accomodate and retain the journals (T2) of the spare roll until the weight of the roll (R2), when roll (R2) is transferred onto the support (16), urges the journals (T2) out of the cradles, which come then in abutment against the crescent-shaped small plates (16*c*). For this purpose, a bead (18*e*) between the accomodating portion and the end is formed by the cradles (18*c*) on the external side.

Likewise the cradles (16*d*) have a rear nose (16*e*) which is shorter than the front nose (16*f*), in order to allow the journals to pass (journals T2) when the spare roll is to take the place of the roll being used, and to retain the spare roll in the accomodating portion which is separated by a bead (16*g*) from the end of the rear nose.

At the upper part (14*c*) of the structure a hook or latch (21) is linked hingedly to a shaft (22). This includes an active end (23*a*) intended for retaining the support (18) in raised position. The support is provided at this location with a hooking projection (18*h*). The latch (23), at the rear end thereof, is provided with a shaft (24) to which is freely and hingedly linked the end of a connecting rod (25), the other end of which has an oblong opening (25*a*) for hinged linking with play to one of the arms (16*b*) of the support (16) by means of a stud (16). It will be noted that the length of the opening (25*a*) is such that when the roll being used is almost entirely paid off, the linking pine (26) between the arm and the connecting rod exerts a pull on the connecting rod in order to tock over the hook (23).

The connecting rod (25) is preferable made of two parts (25*b*–25*c*) so as to be adjustable lengthwise by means of a screw-nut system (28) positioned at the ends of the parts which are facing one another. This is in order to effect the adjustable raising of the support (16) by the connecting rod (25), as will be seen later on.

The connecting rod (25) is urged back permanently in the upper position by a spring (20) attached to the structure, in order to prevent the latch (23) from being rocked over by the weight of the connecting rod.

It will be seen moreover that when the spare roll (2) is placed within the cradles (18*c*), this roll is braked in rotation by an elastic blade (30) secured to the wall plate (1), to prevent the roll's being paid off during the dispensing with the other roll. In this respect, it will be pointed out that the roll (R2) must be mounted with the free end of the web upraised backwardly to be wedged in by the blade (30) and to be placed automatically on the other web rolled on the drum (3) when the roll (R2) takes the place of the roll (R1) on the support (16).

In the case of the free end of roll (R2) being placed inadvertently so that the front of the roll hangs down, the end will nevertheless be automatically placed on the other web at the time of the lowering of the roll (R2) through the intermediary of a curved elastic blade (31) mounted slidably within a slideway (32) integral with a closing hood (33) and returned upwardly by a spring (34) attached to the hood, as shown in FIGS. 6 and 7. It will be understood that in order to prevent any mistake in placing the rolls in their support, a differentiation of the ferrules is provided, for example, by means of different colors with assembly instructions on the hood.

It will be noted, moreover, that parallel small bars (35) secured to the structure (14) extend above the drum (3) up to the proximity of the cradles (16*d*). The free ends of the small bars are shouldered at (35*a*) to serve as abutment for the journals (T1 or T2) when the support (26) is raised to release the roll being used when this roll is practically empty. This prevents the roll, while being driven by the rotation of the drum, from being engaged with the rear of the drum. On the contrary, due to the reaction and to the outwardly offsetting of the rotational axis of the roll relative to the rotational axis of the drum, the roll is discharged in the direction of the hood where an appropriate receptacle (36) receives it for the completion of the simultaneous dispensing with the spare roll which has taken the place of the roll being used in the support (16).

It will be seen, moreover, that in order to prevent the engagement of the free end of the web of the roll (R2) when this roll is lowered, a curved elastic blade (37) is provided behind the cross piece (16*a*) of the support (16), the blade extending in front of the crosspiece and being raised upwardly. This blade can also serve, as illustrated, as a fastening point for a flexible rod (38) or equivalent organ intended for applying the end of the rolled up web on the drum, and for directing it toward the outlet opening provided between the inclined plance (1*a* ) and the lower portion of the hood (33).

A shock absorber block (39) is secured to the structure (14) opposite and abutment lug (18*i*) formed on the support (18), in order to attenuate the shock, as well as the noise produced by the support (18) when the support has released its roll and is returned towards the hook (23) by the spring (27) thereof.

A window (40) of a convenient size is provided on the hood (33) to visualize quickly the loading state of the apparatus.

The operation of the device in accordance with the invention will now be described, more particularly with reference to FIGS. 5, 6 and 7 of the drawings.

Figure 2:
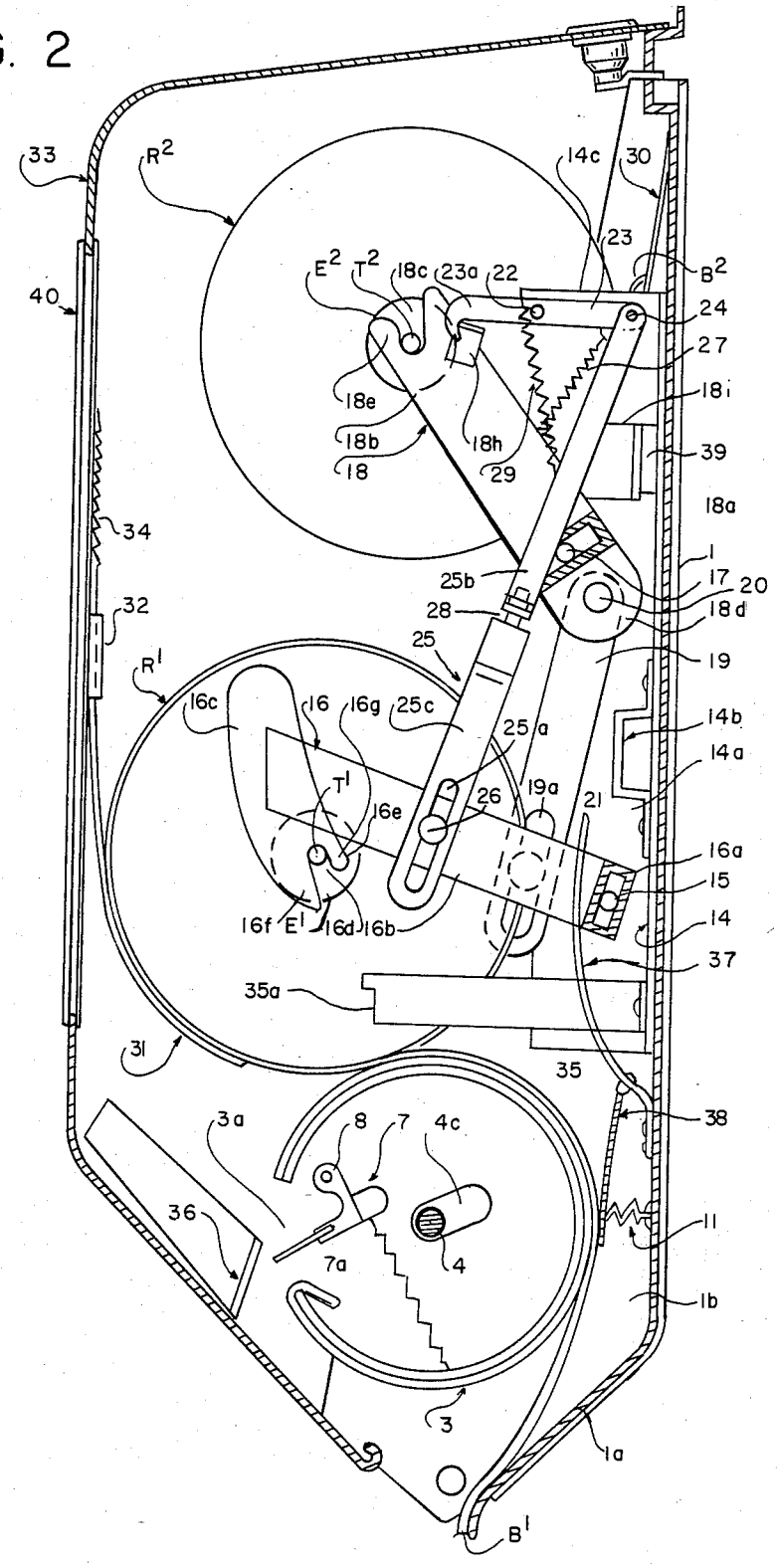
Figure 3:
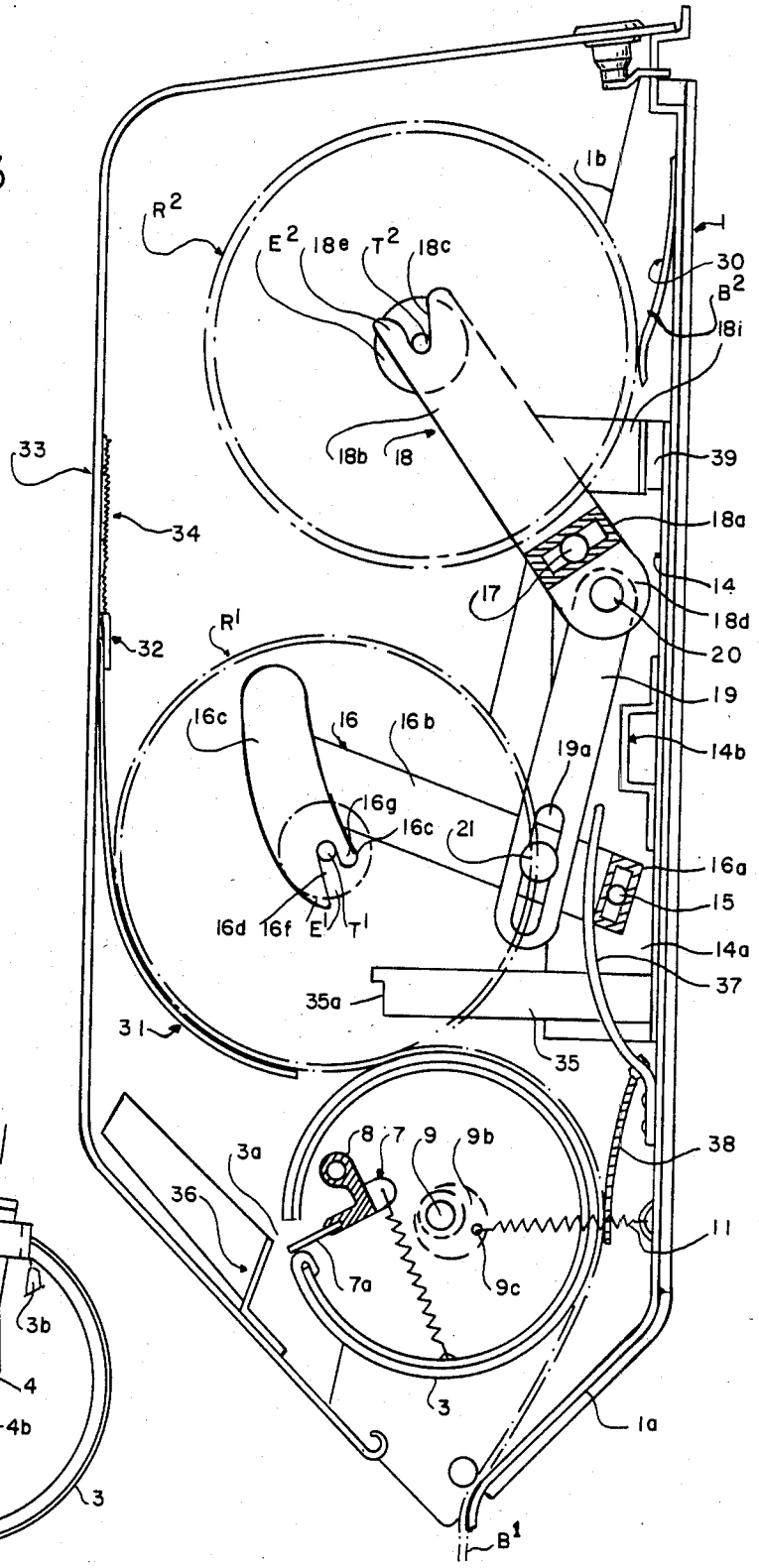
Figure 4:
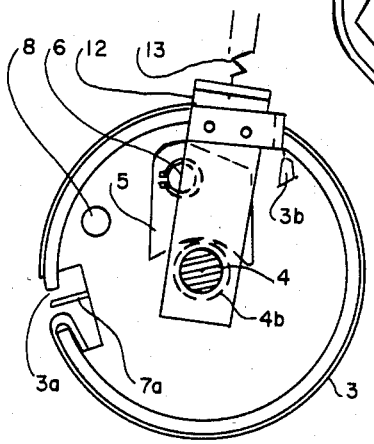
FIG. 4 is a partial view along the line 4—4 of FIG. 1, and showing the starting and non-return abutment organs of the cutting drum.

The apparatus is shown in FIGS. 1 and 2 in the loaded position, i.e., with fresh rolls (R1 and R2) positioned on their respective supports (16 and 18).

It will be appreciated that it is merely necessary to pull the web (B1) of the roll (R1) protruding beneath the apparatus to drive rotatably the drum and the toothed blade (*7a*), in order to cause this blade to project out of the drum and to penetrate into the material which is stretched on either side. After severing, the drum is returned to the initial position thereof thanks to the staring and abutting organs, and the user automatically has a length of web equal to the circumference of the drum.

It is possible to dispense a given number of web in this manner, until the roll (R1) is being paid off. It will be understood that as the roll (R1) is being paid off, the support (16) has been lowered while pivoting on the axis (15) thereof through the intermediary of a return spring (41). When only a few web lengths remain on the roll being used (the number of the remaining webs being adjusted by the small rod (25)), the small rod is attracted by the stud (26) connected hingedly with the support (16), causing the latch (23) to be rocked over the axis (22) thereof and effecting thereby the release of the support (18) of the spare roll (FIG. 5).

Due to the weight of the roll (R2), the support (18) is pivoted on the axis (17) thereof, driving with it the small rod (19) connected to the support (16) of the roll being used, at the same time causing the support (16) to be raised by pivoting on the axis (15) thereof. The pairs of cradle arms of each support move towards one another in close juxtaposition, and the journals (T2) of the roll (R2) are cleared from their cradles (18*c*) by gravity to come in abutment against the crescent-shaped plates (16*c*) of the support (16), as shown in FIG. 6. The motion being continued, the journals (T2) escape from the end of the rear noses of the cradles (16*d*) and are positioned at the bottom of the cradles by the reverse lowering motion of the support (16) which is at this time driven by the connecting rod (19) urged back by the upper support (18) released from its roll (R2) and returned by its roll (27) into the hooking position (FIG. 7).

At the beginning of the raising motion of the support (16), the roll being used (R1) which has been released from the cradles (16*d*) is abutted against the small bars (35), as shown by the broken lines of FIG. 6. Then, the roll (R1) is passed between the elastic blade (31) which has just escaped from the roll at the time of the advancement thereof, and rolls on the drum (3) to be received into the receptacle (36) of the hood.

As may be seen from FIG. 7, the roll (R2) has therefore taken the place of roll (R1) and the free end of the web (B2) thereof is ready to be rolled up in the drum above the remaining web of roll (R1), either because the web (B2) has been placed correctly at the rear of the apparatus to be applied naturally on the drum during the transfer of the roll (R2), or because the web is guided by the elastic blade (31) which has accompanied the roll (R2) to be positioned adjacent the drum. Two webs are going to be dispensed at the same time by manual pull until the roll (R1) has been entirely paid off.

According to one of the alternative embodiments illustrated in FIG. 8, there has been provided an efficient guiding of the spare roll (R2) when this roll escapes from the cradles of the roll holder (18) in order to permit the journals (T2) thereof to be securely engaged within the crades of the roll holder (16). For this purpose, there is secured to the base plate (1) a generally U-shaped piece of metal or other rigid material (42), the wings (42*a*) of which extend above the drum (3) appreciably beyond the rotational axis thereof.

The wings (42*a*) are bent up at their vertical ends to form stops (42*b*) extending up to the level where the two roll holders are crossed at the time of the transfer of the spare roll on the support of the roll being used. The ends of the wings (42*a*) thus prevent the roll being used (R1), which is almost empty, from being engaged behind the drum.

In accordance with another embodiment, as illustrated in FIGS. 9 and 10, there is provided an adjustable pressure of the roll (R1) on the drum (3) in dependence upon the diameter thereof. For this purpose, the roll holder (6) is equipped with a coil spring (43) which is adjustably attached (arrow F) at an end on the base plate (1), so that the line of action of the spring, when the roll (R1) is new, will form a very flattened triangle with the fastening points and the pivot pin (15) of the roll holder (FIG. 9). The coil spring may be attached on a screw threaded rod (44) between two nuts (45) while the other end is attached to the roll holder (16) in a particular location (16*h*).

It will be understood that, in this position, the spring (43) does not exert a substantial pull on the roll holder, the weight of which alone is sufficient to provide the necessary contact pressure with the drum.

On the contrary, as the roll (R1) is being paid off, and therefore as the diameter thereof is decreasing, the triangle formed by the fastenings (16*h*–45) and the pin (15) becomes greater, and the pulling force of the spring (43) is increased (FIG. 10).

The pressure is adjustable by varying the fastening point of the spring on the spring (44) by shifting the nuts (45).

According to a further characteristic in another embodiment, provisions have been made to improve the safety at the level of the lower opening for the passage of webs of material to be pulled out. More particularly, an object has been to prevent the fingers of the user from engaging the opening, which must be of a sufficient width for the passage of the webs of both rolls.

For this purpose, a device is provided at the level of the opening and under the drum, the device including, for instance, two pins (46) supported by each wing of the base plate of the apparatus, a hollow shaft (47), or a contoured tube available on the market being mounted for free rotation on these pins. This shaft is driven in the same direction as the drum through the intermediary of a belt (48) positioned within the appropriate grooves (47*a*) of the shaft (35) and (3*c*) of the drum. As illustrated in FIG. 11, when the web (B2) of the spare roll is paid off at a time with the web (B1), by pulling the protruding end, the shaft (47) is rotated in the same direction as the drum, and facilitates thereby the passage through the opening.

I claim:

1. A dispensing device for rolled webs comprising a roll being used supported by a first support and a spare roll supported by a second support, a rigid structure having the two supports pivotally mounted thereon, a small rod linked hingedly to the two supports, wherein the roll being used is ejected and the spare roll is transferred automatically to the first support; means linked hingedly to the first support releasing the second support from the connecting means when the roll being used is almost entirely paid off; an interlocking means for controlling the support of the spare roll, and a spring which urges back the first support with its fresh roll.

2. The dispensing apparatus of claim 1 having a connecting rod for interlocking and releasing the spare roll, the connecting rod linked freely and hingedly and returned elastically on one of the arms of the support of the roll being used, the connecting rod linked hingedly to one end of a hook mounted around the center line of an element of rigid structure, and the opposite end of the hook is contoured.

3. The dispensing apparatus of claim 2 wherein an oblong opening in the link for the connecting rod on the arm of the support of the roll being used, the length of the rod is sufficient that, when the roll being used is almost entirely paid off, the linking pin between the arm and the connecting rod exerts a pull on the connecting rod to rock over the hook and release the support from the spare roll.

4. The dispensing apparatus of claim 3 wherein the connecting rod between the hook and the support of the roll being used consists of two portions connected by a means for adjusting the length.

5. The dispensing apparatus of claim 1 wherein contoured cradles are formed with the ends of the arms of the support of the spare roll and the ends of the arms of the support of the roll being used, ferrules with journals on the ends of the reel of the webs being dispensed; the ends of the arms of the support of the spare roll are spaced from each other for a distance which is greater than the distance of separating the ends of the arm of the support of the roll being used, a small connecting rod to cause the supports to cross each other when the supports are moved toward each other.

6. The dispensing apparatus of claim 5 wherein crescent-shaped small plates are provided at the lower end of the cradles for receiving the roll being used.

7. The dispensing apparatus of claim 6 wherein the cradles for receiving the journals are oriented and configured for retaining the journals until the moment they are maintained against the crescent-shaped small plates, and the cradles for receiving the journals of the roll being used are provided with a rear nose and a front nose shorter than the rear nose, and beads retaining the journals within the circular bottom of the cradles.

8. The dispensing apparatus of claim 1 having a means for severing and separating the material pulled, the means for severing being caused to project out of the drum by a manual pull on the portion of the web protruding from the apparatus, a means for starting the drum, a rigid structure for supporting the supports of the rolls, a base plate for fastening the rigid structure to a wall, the rigid structure having lateral sides to support the mounting means, a closing hood covering the whole of the unit, and a means for receiving the roll being used when the roll being used is almost entirely paid off.

9. The dispensing apparatus of claim 8 having a hood containing a receptacle for receiving a paid-off roll.

10. The dispensing apparatus of claim 8 having an elastic means to retain the free end of the rolled up web, the elastic means abutting against the roll.

11. The dispensing apparatus of claim 10 having a curved blade integral with the wall fastening plate and extending in front of a linking crosspiece of the lower support.

12. The dispensing apparatus of claim 8 wherein an elastic blade is supported slidably in a slideway of the hood and returned by a spring in the upper portion of the hood.

13. The dispensing apparatus of claim 1 having a U-shaped contoured piece secured to the base plate with wings extending above the drum, and vertically bent up ends forming abutments disposed at the level at which the two roll-holders cross each other when the spare roll is transferred.

14. The dispensing apparatus of claim 1 having a coil spring fixedly attached to the roll holder in a crosswise adjustable manner on a fastening device integral with the base plate, the connection of the fastening points and of the pin defining a triangle, the spring forming the hypotenuse of the triangle, the triangle being flattened when the roll is new and the triangle being increased as the diameter of the roll being used decreases.

15. The dispensing apparatus of claim 1 having a hollow shaft mounted immediately below the drum at the level of the lower opening for passage of webs of material, and transmission means for driving the shaft rotatably in the same direction as the drum.

16. The dispensing apparatus of claim 15 wherein the transmission means is a belt cooperating with corresponding grooves of the shaft and of the drum.

* * * * *